US010109245B2

(12) United States Patent
Zeng et al.

(10) Patent No.: US 10,109,245 B2
(45) Date of Patent: Oct. 23, 2018

(54) DRIVING METHOD AND DEVICE OF LIQUID CRYSTAL PANEL

(71) Applicant: Shenzhen China Star Optoelectronics Technology Co., Ltd., Shenzhen, Guangdong (CN)

(72) Inventors: Dekang Zeng, Guangdong (CN); Yuhong Fu, Guangdong (CN); Wenqin Zhao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 173 days.

(21) Appl. No.: 15/313,087

(22) PCT Filed: Sep. 27, 2016

(86) PCT No.: PCT/CN2016/100299

§ 371 (c)(1),
(2) Date: Nov. 21, 2016

(87) PCT Pub. No.: WO2018/040162

PCT Pub. Date: Mar. 8, 2018

(65) Prior Publication Data

US 2018/0182321 A1 Jun. 28, 2018

(30) Foreign Application Priority Data

Aug. 30, 2016 (CN) ..... 2016 1 0777164

(51) Int. Cl.
*G09G 3/36* (2006.01)

(52) U.S. Cl.
CPC ..... *G09G 3/3607* (2013.01); *G09G 3/3614* (2013.01); *G09G 2320/0223* (2013.01);
(Continued)

(58) Field of Classification Search
CPC ..... G09G 3/3607; G09G 3/3614; G09G 2320/0223; G09G 2320/0233; G09G 2320/0285
See application file for complete search history.

(56) References Cited

U.S. PATENT DOCUMENTS

2004/0246213 A1* 12/2004 Credelle ..... G09G 3/3614 345/87
2004/0246280 A1* 12/2004 Credelle ..... G09G 3/3607 345/692

* cited by examiner

*Primary Examiner* — Sejoon Ahn
(74) *Attorney, Agent, or Firm* — Andrew C. Cheng

(57) ABSTRACT

A driving method and a driving device of a liquid crystal panel are provided. The driving method includes: creating a position lookup table provided with a first value and a second value respectively indicating a sub-pixel not requiring grayscale compensation and a target sub-pixel requiring grayscale compensation and further for indicating which reference sub-pixel will be used for performing grayscale compensation; creating a compensation lookup table and setting a compensated grayscale value of the target sub-pixel according to a one-to-one relationship between a current grayscale value of the target sub-pixel and a grayscale value of a corresponding reference sub-pixel; and during driving the liquid crystal panel to display, determining the target sub-pixel requiring grayscale compensation and obtaining the corresponding reference sub-pixel according to the position lookup table, obtaining the compensated grayscale value from the compensation lookup table and driving the target sub-pixel to display according to the compensated grayscale value.

10 Claims, 3 Drawing Sheets

(52) U.S. Cl.
CPC ..... *G09G 2320/0233* (2013.01); *G09G 2320/0285* (2013.01)

DRIVING METHOD AND DEVICE OF LIQUID CRYSTAL PANEL

TECHNICAL FIELD

The invention relates to the field of liquid crystal display technology, and more particularly to a driving method and a driving device of a liquid crystal panel.

DESCRIPTION OF RELATED ART

A liquid crystal display (LCD) is a commonly used electronic device, because of its advantages of low power consumption, small volume and lightweight, it has been favored by users. The current liquid crystal display mainly is a thin film transistor (TFT) liquid crystal display.

The liquid crystal panel technology is a display technology of rotating a specific angle based on a voltage applied onto a liquid crystal molecule. By changing a driving voltage applied onto two ends of the liquid crystal molecule, the liquid crystal molecule is driven to generate a corresponding rotation, a propagation direction of light of a light source generated from a backlight unit is changed, so that different grayscale brightnesses can be realized at locations of red, green and blue color filters on a liquid crystal layer by different rotation angle of the liquid crystal molecule. By combining red, green and blue sub-pixel display points with different grayscale brightnesses, a single pixel display point with different color variations can be achieved.

A characteristic of the liquid crystal molecule is that if a polarity of the driving voltage applied onto the liquid crystal molecule always is not changed, which would result in the liquid crystal molecule being destroyed and cannot be recovered. Therefore, in the situation of maintaining a value of the driving voltage applied onto the two ends of the liquid crystal molecule to be not changed, the voltage polarity of the driving voltage is necessarily to be reversed every once in a while. That is, a positive polarity and a negative polarity of the driving voltage relative to a common electrode are mutually swapped. Herein, positive and negative of the polarities of the driving voltage are relative to the common electrode of the liquid crystal panel, when a voltage of a pixel electrode is higher than a voltage of the common electrode, it is referred to as positive polarity, whereas when the voltage of the pixel electrode is lower than the voltage of the common electrode, it is referred to as negative polarity. Regardless of the voltage of the pixel electrode is positive polarity or negative polarity, as long as absolute values of the voltages are equal, same grayscale brightnesses would be obtained. Therefore, when an absolute value of a difference between the voltage of the pixel electrode and the voltage of the common voltage is fixed, regardless of the voltage polarity of the pixel electrode is positive or negative, the grayscale brightness exhibited by a pixel is the same but rotation directions of the liquid crystal molecule are opposite, so as to avoid the property damage caused by the liquid crystal molecule always being fixed to a same direction. Conventional polarity inversion manners include a frame inversion, a row/column inversion, a dot inversion and so on.

For a conventional liquid crystal panel with architecture of dual gate line and single data line, in order to achieve a small image flicker, a driving method of 2-dot inversion usually is adopted. That is, pixel electrodes respectively at two sides of each data line in a same row have an arrangement manner of both being a positive polarity or a negative polarity, because of the influence of a RC delay of a signal transmission line, it will result in charging problem of sub-pixels respectively at two sides of each data line in a same row are not identical, and one of the sub-pixels is insufficiently charged which results in the displayed image becoming dark, so that the display quality is affected as a result.

A conventional improvement method mainly is to reduce the impedance of the signal transmission line so as to reduce the RC delay. In particular, one method is that a material of the signal transmission line is a material with high conductivity to reduce the impedance, and such method would greatly increase the cost and result in decreased competitiveness of the product; and another method is to increase a width of the signal transmission line so as to achieve the reduction of the impedance, but such method would reduce the aperture ratio of the panel.

SUMMARY

In view of the shortcomings of the prior art, the invention provides a driving method and a driving device of a liquid crystal panel, so as to improve the problem of display brightnesses of adjacent sub-pixels being uneven caused by RC delay of signal transmission line.

In order to achieve the above objective, the invention proposes the following technical solutions.

A driving method of a liquid crystal panel includes: creating a position lookup table for all sub-pixels of the liquid crystal panel, wherein the position lookup table is provided with a first value and a second value, the first value indicating a sub-pixel at a corresponding position not requiring grayscale compensation, the second value indicating a target sub-pixel at a corresponding position requiring grayscale compensation, and further the second value indicates which reference sub-pixel will be used for performing grayscale compensation; creating a compensation lookup table and setting a compensated grayscale value of the target sub-pixel according to a one-to-one relationship between a current grayscale value of the target sub-pixel and a grayscale value of a corresponding reference sub-pixel; and during driving the liquid crystal panel to display, determining the target sub-pixel requiring grayscale compensation and obtaining the corresponding reference sub-pixel according to the position lookup table, obtaining the compensated grayscale value from the compensation lookup table according to the current grayscale value of the target sub-pixel and the grayscale value of the corresponding reference sub-pixel, and driving the target sub-pixel to display according to the compensated grayscale value.

In an embodiment, according to a sub-pixel arrangement manner and a polarity inversion driving manner of the liquid crystal panel, positions of sub-pixels requiring grayscale compensation in the liquid crystal panel and positions of corresponding reference sub-pixels will be used for performing grayscale compensation are determined and then the position lookup table is created.

In an embodiment, the corresponding reference sub-pixel is one selected from that: two sub-pixels located in the same row with the target sub-pixel and respectively located in the nearest preceding column and the nearest succeeding column of the target sub-pixel, and three sub-pixels located in the nearest upper row of the target sub-pixel and respectively located in from the nearest preceding column to the nearest succeeding column of the target sub-pixel.

In an embodiment, the first value is the digit 0, and the second value is a non-zero digit.

In an embodiment, the liquid crystal panel is a liquid crystal panel with dual-gate-line and single-data-line architecture, and a 2-dot inversion driving manner is adopted; an even column of sub-pixels in the liquid crystal panel each are the target sub-pixel requiring grayscale compensation, and the corresponding reference sub-pixel is the sub-pixel located in the nearest upper row and the nearest succeeding column of the target sub-pixel.

In an embodiment, the first value is the digit 0, and the second value is the digit 3.

In an embodiment, the compensated grayscale value is greater with 0~5 than the current grayscale value.

In an embodiment, in the compensation lookup table, for a same current grayscale value, the compensated grayscale value corresponding to a relatively large grayscale value of reference sub-pixel is not smaller than the compensated grayscale value corresponding to a relatively small grayscale value of reference sub-pixel.

In an embodiment, the current grayscale value of the target sub-pixel and the grayscale value of the corresponding reference sub-pixel are obtained according to a grayscale lookup table.

The invention further provides a driving device of a liquid crystal panel. The driving device includes a driving module and a storage module. The storage module includes a first storage unit, a second storage unit and a third storage unit. The first storage unit is configured for storing a position lookup table, a second storage unit is configured for storing a grayscale lookup table, and the third storage unit is configured for storing a compensation lookup table. The driving module is configured for reading the position lookup table, the grayscale lookup table and the compensation lookup table stored in the storage module according to received video signal, inputting a display signal to the liquid crystal panel as per the above described driving method and thereby driving the liquid crystal panel to display an image.

Efficacy of the invention is that: the driving method and driving device of a liquid crystal panel according to the embodiments of the invention, by setting the position lookup table and the compensation lookup table, during driving to display, sub-pixels of being insufficient charged in the position lookup table are determined as target sub-pixels requiring grayscale compensation, the grayscale value of each target sub-pixel is increased for compensation according to the compensation lookup table, and then each target sub-pixel is driven to display according to the compensated grayscale value, so that the display brightness of each target sub-pixel tends to coincide with that of the adjacent sub-pixel, the problem of uneven display brightness between adjacent sub-pixels caused by RC delay of signal transmission line is improved consequently.

DETAILED DESCRIPTION OF EMBODIMENTS

Figure 1:
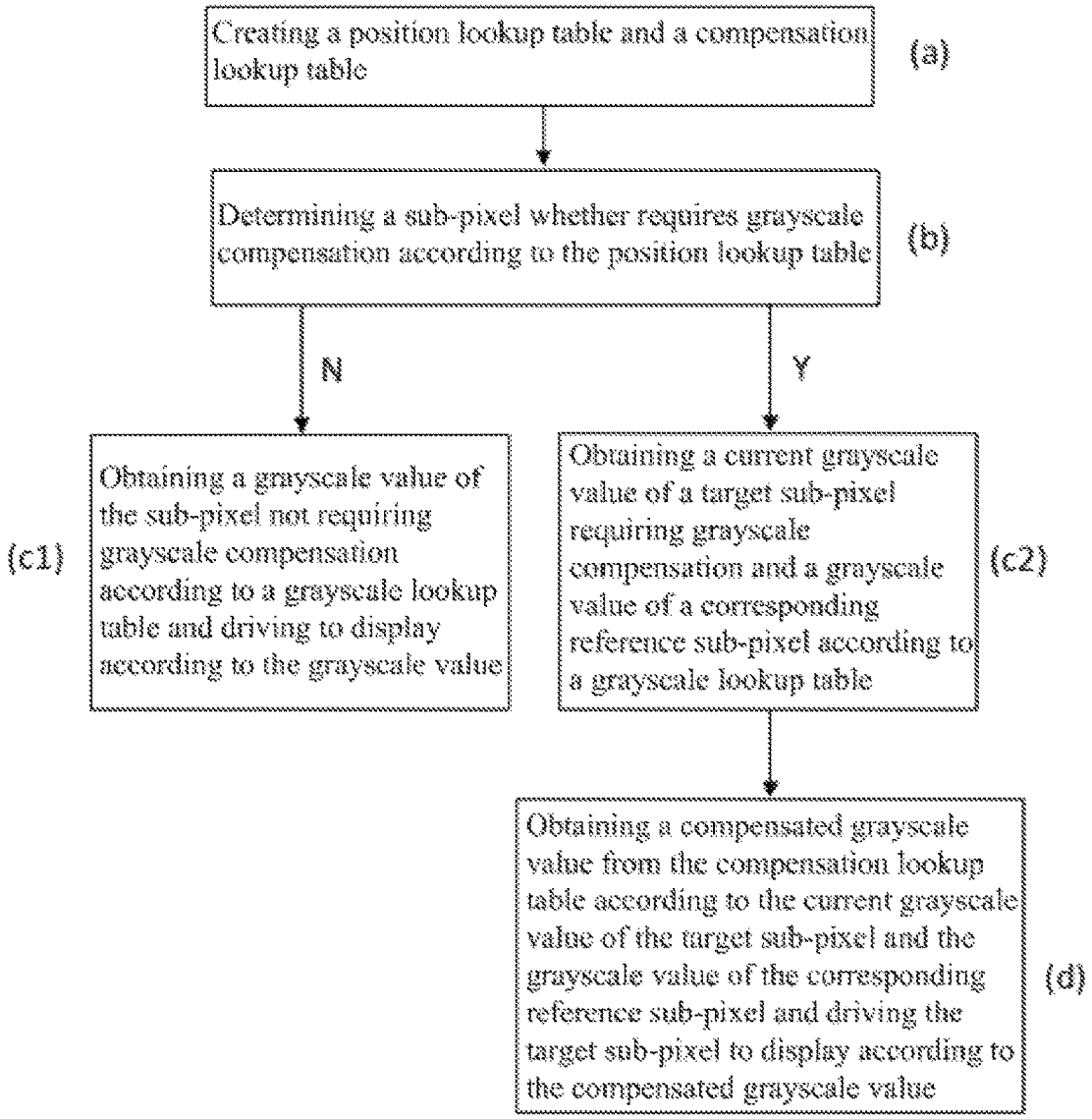
FIG. 1 is a flowchart of a driving method of a liquid crystal panel according to an embodiment of the invention.

In order to make objectives, technical solutions and advantages of the invention become more apparent, concrete embodiments of the invention will be described in detail below with reference to accompanying drawings. Examples of these preferred embodiments would be illustrated in the drawings. The illustration in the drawings and the embodiments of the invention described according to the accompanying drawings only are exemplary, and the invention is not limited to these embodiments.

Herein, it should be noted that, in order to avoid unnecessary details to obscure the invention, the accompanying drawings only illustrate structures and/or processing steps closely related to the solution of the invention and omit other details little related to the invention.

An illustrated embodiment firstly provides a driving method of a liquid crystal panel. As shown in FIG. 1, the method includes steps as follows.

Step (a): creating a position lookup table and a compensation lookup table. Herein, the position lookup table is provided with a first value and a second value, the first value is for indicating that a sub-pixel at a corresponding position not requiring grayscale compensation, the second value is for indicating that a target sub-pixel at a corresponding position requiring grayscale compensation, and further the position lookup table indicates which reference sub-pixel will be used for performing grayscale compensation. In the compensation lookup table, according to a one-to-one relationship between a current grayscale value of the target sub-pixel and a grayscale value of a corresponding reference sub-pixel, a grayscale value after compensation (also referred to as compensated grayscale value) of the target sub-pixel is set. The first value may be the digit 0, and the second value may be a non-zero digit; and of course they may use other symbols for identification.

Step (b): determining whether a sub-pixel requires grayscale compensation according to the position lookup table. If a position in the position lookup table is indicated by the first value, the sub-pixel in the position does not require grayscale compensation; and if the position in the position lookup table is indicated by the second value, determining the sub-pixel at the position as target sub-pixel requiring grayscale compensation and obtaining a corresponding reference sub-pixel.

Step (c1): obtaining a grayscale value of the sub-pixel not requiring grayscale compensation according to a grayscale lookup table and then driving the sub-pixel to display according to the obtained grayscale value;

Step (c2): obtaining a current grayscale value of the target sub-pixel and a grayscale value of the corresponding reference sub-pixel according to the grayscale lookup table.

Step (d): obtaining a compensated grayscale value from the compensation lookup table according to the current grayscale value of the target sub-pixel and the grayscale value of the corresponding reference sub-pixel and driving the target sub-pixel to display according to the compensated grayscale value.

In the step (a), according to a sub-pixel arrangement manner and a polarity inversion driving manner of a liquid crystal panel, positions of sub-pixels requiring grayscale compensation in the liquid crystal panel and positions of corresponding reference sub-pixels will be used for performing grayscale compensation are determined, and then the position lookup table is created as a result. Generally, first sub-pixels corresponding to a signal polarity inversion would encounter the problem of being insufficient charged, and therefore these sub-pixel usually are target sub-pixels requiring grayscale compensation. For the selection of each corresponding reference sub-pixel, an sub-pixel adjacent to the corresponding target sub-pixel usually is selected and the sub-pixel specifically may be one selected from that: two sub-pixels located in the same row with the target sub-pixel and respectively located in the nearest preceding column and the nearest succeeding column of the target sub-pixel and, and three sub-pixels located in the nearest upper row of the target sub-pixel and respectively located in from the nearest preceding column to the nearest succeeding column of the target sub-pixel. Specific positions are determined according to the sub-pixel arrangement manner and the polarity inversion driving manner, it is mainly to select out sub-pixels without the problem of being insufficient charged from the above positions.

For a current grayscale value of a target sub-pixel and a grayscale value of a corresponding reference sub-pixel, a corresponding compensated grayscale value can be obtained from the compensation lookup table. Generally, the compensated grayscale value is greater with 0~5 than the current grayscale value. Moreover, in the compensation lookup table, for a same current grayscale value, the compensated grayscale value corresponding to a relatively large grayscale value of reference sub-pixel is not smaller than the compensated grayscale value corresponding to a relatively small grayscale value of reference sub-pixel.

Figure 2:
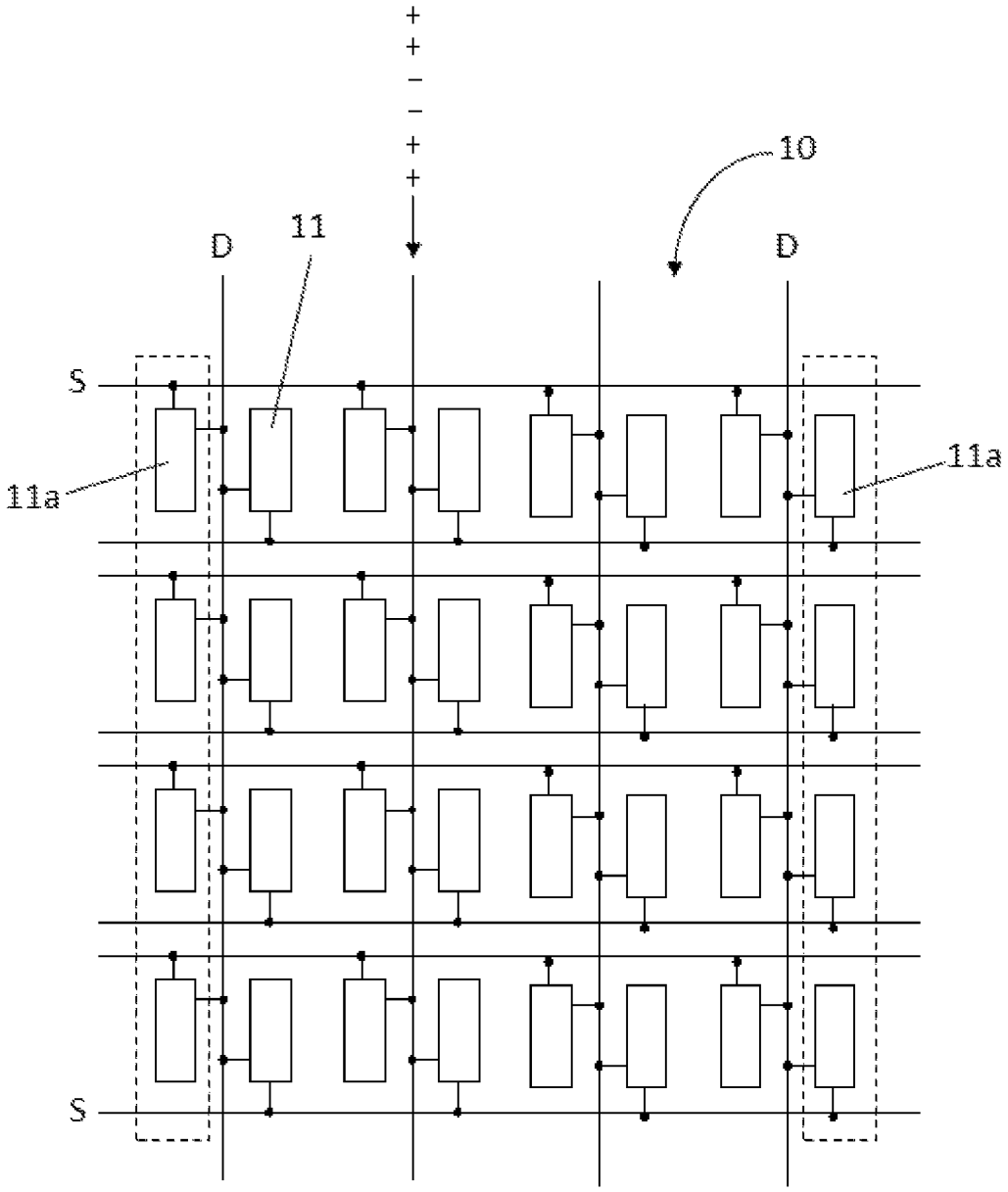
FIG. 2 is a structural schematic view of a liquid crystal panel with a dual-gate-line architecture according to an embodiment of the invention.

Specifically, in the illustrated embodiment, as shown in FIG. 2, the liquid crystal panel is a liquid crystal panel 10 with dual-gate-line and single-data-line architecture and employs a 2-dot inversion driving manner. Each row of sub-pixels 11 are connected to two gate lines S, adjacent two columns of sub-pixels 11 are connected to a same one data line D, and sub-pixels located at two sides of each data line D and in a same row have an arrangement manner of simultaneously being with positive polarity or simultaneously being with negative polarity. In the liquid crystal panel 10 with such architecture, as shown in FIG. 2, one column of auxiliary sub-pixels 11*a* are disposed at outside of the first column of sub-pixels 11 and are connected to a same one data line D with the first column of sub-pixels 11. Likewise, another column of auxiliary sub-pixels 11*a* are disposed outside of the last one column of sub-pixels 11 and are connected to a same one data line D with the last one column of sub-pixels 11. It is noted that, FIG. 2 only exemplarily illustrates some sub-pixels, some gate lines and some data lines.

For the liquid crystal panel 10 with above-mentioned architecture and driving manner, the sub-pixels at two sides of each data line D and in a same row have an arrangement manner of both being with positive polarity or both being with negative polarity. During driving each even column of sub-pixels, the signal polarity is reversed and thus there is the occurrence of insufficient charging, and therefore the even column of sub-pixels are determined as target sub-pixels requiring grayscale compensation, and corresponding reference sub-pixels each are determined to be the sub-pixel at the nearest succeeding column and the nearest upper row of the corresponding target sub-pixel. Accordingly, a position lookup table as shown in Table 1 is created/built.

TABLE 1

| | | | | | |
|---|---|---|---|---|---|
| 0 | 3 | 0 | 3 | 0 | 3 |
| 0 | 3 | 0 | 3 | 0 | 3 |
| 0 | 3 | 0 | 3 | 0 | 3 |
| 0 | 3 | 0 | 3 | 0 | 3 |

In the Table 1, the first value is set to be the digit 0, and the second value is set to be the digit 3.

Furthermore, for the liquid crystal panel 10 with the above mentioned architecture and driving manner, a compensation lookup table as shown in Table 2 is created.

TABLE 2

| | A2 | | | | | | | | |
|---|---|---|---|---|---|---|---|---|---|
| | 0 | 32 | 64 | 96 | 128 | 160 | 192 | 224 | 255 |
| A1 | | | | | A3 | | | | |
| 0 | 0 | 1 | 1 | 1 | 2 | 2 | 2 | 3 | 3 |
| 32 | 33 | 33 | 33 | 34 | 34 | 34 | 35 | 35 | 35 |
| 64 | 65 | 65 | 65 | 66 | 66 | 66 | 66 | 67 | 67 |
| 96 | 98 | 98 | 98 | 99 | 99 | 99 | 100 | 100 | 100 |
| 128 | 131 | 131 | 131 | 131 | 132 | 132 | 132 | 132 | 133 |
| 160 | 163 | 163 | 163 | 163 | 163 | 164 | 164 | 164 | 164 |
| 192 | 195 | 195 | 195 | 195 | 196 | 196 | 196 | 196 | 196 |
| 224 | 227 | 227 | 227 | 227 | 227 | 228 | 228 | 228 | 228 |
| 255 | 255 | 255 | 255 | 255 | 255 | 255 | 255 | 255 | 255 |

In the Table 2, A1 is corresponding to the first column in the table and represents a current grayscale value of a target sub-pixel, and a variation range thereof being 0~255; A2 is corresponding to the first row in the table and represents a grayscale value of a reference sub-pixel, and a variation range thereof being 0~255; A3 is corresponding to values in the middle of the table and represents a compensated grayscale value. As shown in Table 2, the compensated grayscale value is increased with respect to the current grayscale value in a range of 0~5, and moreover in the compensation lookup table, for a same current grayscale value, the compensated grayscale value corresponding to a relatively large grayscale value of reference sub-pixel is not smaller than the compensated grayscale value corresponding to a relatively small grayscale value of reference sub-pixel.

For example, in the compensation lookup table of Table 2, variation ranges of the current grayscale value of the target sub-pixel and the grayscale value of the reference sub-pixel are each in a range of 0~255, the table only lists some representative grayscale data for reference, other data can be calculated according to the data listed in the table by a linear algorithm, but the embodiment of the invention is not limited thereto. As shown in Table 2, if the current grayscale value of the target sub-pixel is 96 and the grayscale value of the corresponding reference sub-pixel is 128, the compensated grayscale value of the target sub-pixel is 99 and increased with 3 relative to the current grayscale value.

For another example, if the current grayscale value of the target sub-pixel is 100 and the grayscale value 100 of the corresponding reference sub-pixel is 100, although the compensated grayscale value corresponding to both the current grayscale value and the grayscale value of the corresponding reference sub-pixel cannot be directly found out from the compensation lookup table of Table 2, it can be found out from the table that the current grayscale value is between 96~128 and the grayscale value of the corresponding reference sub-pixel correspondingly is between 96~128, according to the compensated grayscales corresponding to two end-points of each of the ranges/intervals, any compensated grayscale value corresponding to the current grayscale value and the grayscale value of the corresponding reference grayscale value within the ranges/intervals can be calculated by bilinear interpolation.

Figure 3:
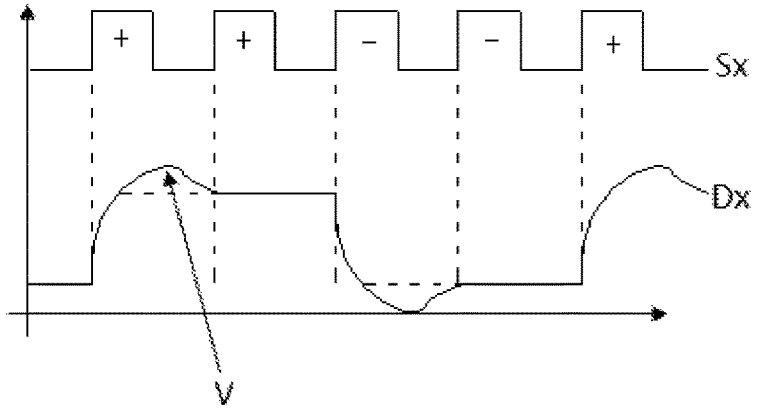
FIG. 3 is a driving waveform diagram of the liquid crystal panel as shown in FIG. 2 according to an embodiment of the invention.

By driving the target sub-pixel to display according to the compensated grayscale value, it can raise the charging voltage of the target sub-pixel, so that a display brightness of the target sub-pixel tends to coincide with that of the adjacent sub-pixel. Specifically, referring to the signal waveform diagram as shown in FIG. 3, where Sx is corresponding to a scan signal waveform, and Dx is corresponding to a data signal waveform. For the target sub-pixel initially/originally having the problem of insufficient charging, the data signal waveform has an increased voltage value, so that the time for the data signal climbing up to an effective charging voltage is shorter and the amount/quantity of charging corresponding to the target sub-pixel is increased consequently.

Figure 4:
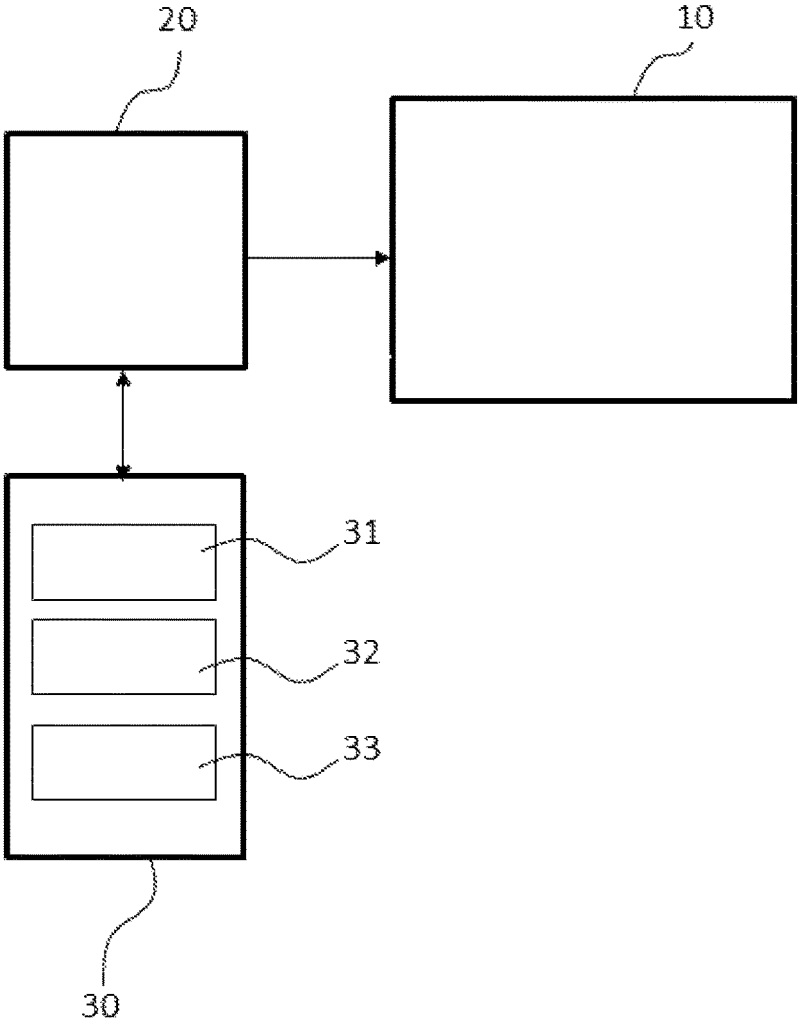
FIG. 4 is a structural schematic view of a driving device of a liquid crystal panel according to an embodiment of the invention.

The invention further provides a driving device of a liquid crystal panel. The driving device inputs a display signal to the liquid crystal panel as per the driving method provided by the above embodiment and drives the liquid crystal panel to display an image. In particular, as shown in FIG. 4, the driving device includes a driving module 20 and a storage module 30. The storage module 30 includes a first storage unit 31, a second storage unit 32 and a third storage unit 33. The first storage unit 31 is configured (i.e., structured and arranged) for storing the position lookup table, the second storage unit 32 is configured for storing the grayscale lookup table, and the third storage unit 33 is configured for storing the compensation lookup table. The driving module 20 is configured for reading the position lookup table, the grayscale lookup table and the compensation lookup table according to received video signal, inputting a display signal to the liquid crystal panel 10 and thereby driving the liquid crystal panel 10 to display an image.

The driving method and driving device of the liquid crystal panel according to the above described embodiments, by setting the position lookup table and the compensation lookup table, during being driven for display, the sub-pixel(s) with insufficient charging in the position lookup table is/are determined as the target sub-pixel(s) requiring grayscale compensation, and then the grayscale value(s) of the target sub-pixel(s) are increased for compensation as per the compensation lookup table, after driving the target sub-pixel(s) to display as per the compensated grayscale value(s), the display brightness of each the target sub-pixel would tend to coincide with that of its adjacent sub-pixel, and as a result the problem of uneven display brightnesses between adjacent sub-pixels caused by RC delay of signal transmission line is improved. Compared with the prior art, the invention only changes the driving manner to reduce the impact of the RC delay on the sub-pixel charging, and therefore it would not increase the hardware cost of the liquid crystal panel. By pre-setting the position lookup table and the compensation lookup table and then performing grayscale compensation according to the position lookup table and the compensation lookup table, the algorithm is simple and therefore it can be applied to a variety of different sub-pixel arrangement manners and polarity inversion driving manners and has good versatility.

It is indicated that, in this specification, the relational terminologies such as "first" and "second" only are intended to discriminate an entity or operation from another entity or operation, and not necessarily to require or imply these entities or operations having such actual relationships or orders existed therebetween. Moreover, the terminology of "including", "containing" or variations thereof is meant to cover non-exclusive inclusion, so that a process, method, article or apparatus including a series of items not only includes listed items but also includes other item(s) not being explicitly listed or inherent item(s) of the process, method, article or apparatus. In the absence of more restrictive conditions, the item limited by the phraseology "including one" does not exclude the existence of additional identical item(s) in the process, method, article or apparatus including the item.

The foregoing discussion is merely specific embodiments of the invention. It should be noted that, for those skilled in the art, on the prerequisite of without departing from the principle of the invention, various improvements and modifications can be made and these improvements and modifications should also be regarded as belonging to the scope of protection of the invention.

What is claimed is:

1. A driving method of a liquid crystal panel, comprising:

creating a position lookup table for all sub-pixels of the liquid crystal panel, wherein the position lookup table is provided with a first value and a second value, the first value indicating a sub-pixel at a corresponding position not requiring grayscale compensation, the second value indicating a target sub-pixel at a corresponding position requiring grayscale compensation, and further the second value indicates which reference sub-pixel will be used for performing grayscale compensation;

creating a compensation lookup table and setting a compensated grayscale value of the target sub-pixel according to a one-to-one relationship between a current grayscale value of the target sub-pixel and a grayscale value of a corresponding reference sub-pixel;

during driving the liquid crystal panel to display, determining the target sub-pixel requiring grayscale compensation and obtaining the corresponding reference sub-pixel according to the position lookup table, obtaining the compensated grayscale value from the compensation lookup table according to the current grayscale value of the target sub-pixel and the grayscale value of the corresponding reference sub-pixel, and driving the target sub-pixel to display according to the compensated grayscale value, wherein according to a sub-pixel arrangement manner and a polarity inversion driving manner of the liquid crystal panel, positions of sub-pixels requiring grayscale compensation in the liquid crystal panel and positions of corresponding reference sub-pixels will be used for performing grayscale compensation are determined, and then the position lookup table is created, wherein the corresponding reference sub-pixel is one selected from that: two sub-pixels located in a same row with the target sub-pixel and respectively located in the nearest preceding column and the nearest succeeding column of the target sub-pixel, and three sub-pixels located in the nearest upper row of the target sub-pixel and respectively located in from the nearest preceding column to the nearest succeeding column of the target sub-pixel, wherein the compensated grayscale value is 5 greater than the current grayscale value, and wherein in the compensation lookup table, for a same current grayscale value, the compensated grayscale value corresponding to a relatively large grayscale value of reference sub-pixel is not smaller than the compensated grayscale value corresponding to a relatively small grayscale value of reference sub-pixel.

2. The driving method of a liquid crystal panel as claimed in claim 1, wherein the first value is the digit 0, and the second value is a non-zero digit.

3. The driving method of a liquid crystal panel as claimed in claim 1, wherein the liquid crystal panel is a liquid crystal panel with dual-gate-line and single-data-line architecture, and a 2-dot inversion driving manner is adopted; an even column of sub-pixels in the liquid crystal panel each are the target sub-pixel requiring grayscale compensation, and the corresponding reference sub-pixel is the sub-pixel located in the nearest upper row and the nearest succeeding column of the target sub-pixel.

4. The driving method of a liquid crystal panel as claimed in claim 3, wherein the first value is the digit 0, and the second value is the digit 3.

5. The driving method of a liquid crystal panel as claimed in claim 1, wherein the current grayscale value of the target sub-pixel and the grayscale value of the corresponding reference sub-pixel are obtained according to a grayscale lookup table.

6. A driving device of a liquid crystal panel, comprising a driving circuit and a storage circuit; wherein the storage circuit comprises a first storage unit, a second storage unit and a third storage unit; the first storage unit is configured for storing a position lookup table, a second storage unit is configured for storing a grayscale lookup table, and the third storage unit is configured for storing a compensation lookup table; the driving circuit is configured for reading the position lookup table, the grayscale lookup table and the compensation lookup table stored in the storage circuit according to received video signal and thereby driving the liquid crystal panel to display an image;

the position lookup table is provided with a first value and a second value, the first value indicating a sub-pixel at a corresponding position not requiring grayscale compensation, the second value indicating a target sub-pixel at a corresponding position requiring grayscale compensation, and further the second value indicates which reference sub-pixel will be used for performing grayscale compensation;

in the compensation lookup table, a compensated grayscale value of the target sub-pixel is obtained according to a one-to-one relationship between a current grayscale value of the target sub-pixel and a grayscale value of a corresponding reference sub-pixel; during driving the liquid crystal panel to display, the driving circuit determines the target sub-pixel requiring grayscale compensation and obtains the corresponding reference sub-pixel according to the position lookup table, obtains the compensated grayscale value from the compensation lookup table according to the current grayscale value of the target sub-pixel and the grayscale value of the corresponding reference sub-pixel, and drives the target sub-pixel to display according to the compensated grayscale value, wherein according to a sub-pixel arrangement manner and a polarity inversion driving manner of the liquid crystal panel, positions of sub-pixels requiring grayscale compensation in the liquid crystal panel and positions of corresponding reference sub-pixels will be used for performing grayscale compensation are determined and then the position lookup table is created, wherein the corresponding reference sub-pixel is one selected from that: two sub-pixels located in a same row with the target sub-pixel and respectively located in the nearest preceding column and the nearest succeeding column of the target sub-pixel, and three sub-pixels located in the nearest upper row of the target sub-pixel and respectively located in from the nearest preceding column to the nearest succeeding column of the target sub-pixel, wherein the compensated grayscale value is 5 greater than the current grayscale value, and wherein in the compensation lookup table, for a same current grayscale value, the compensated grayscale value corresponding to a relatively large grayscale value of reference sub-pixel is not smaller than the compensated grayscale value corresponding to a relatively small grayscale value of reference sub-pixel.

7. The driving device of a liquid crystal panel as claimed in claim 6, wherein the first value is the digit 0, and the second value is a non-zero digit.

8. The driving device of a liquid crystal panel as claimed in claim 6, wherein the liquid crystal panel is a liquid crystal panel with dual-gate-line and single-data-line architecture, and a 2-dot inversion driving manner is adopted; an even column of sub-pixels in the liquid crystal panel each are the target sub-pixel requiring grayscale compensation, and the corresponding reference sub-pixel is the sub-pixel located in the nearest upper row and the nearest succeeding column of the target sub-pixel.

9. The driving device of a liquid crystal panel as claimed in claim 8, wherein the first value is the digit 0, and the second value is the digit 3.

10. The driving device of a liquid crystal panel as claimed in claim 1, wherein the current grayscale value of the target sub-pixel and the grayscale value of the corresponding reference sub-pixel are obtained according to the grayscale lookup table.

* * * * *